US007717759B2

(12) United States Patent
Ishigami

(10) Patent No.: US 7,717,759 B2
(45) Date of Patent: May 18, 2010

(54) FEMALE TERMINAL WITH GUIDING PIECE

(75) Inventor: Masaaki Ishigami, Osaka (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 37 days.

(21) Appl. No.: 12/244,238

(22) Filed: Oct. 2, 2008

(65) Prior Publication Data

US 2009/0036001 A1 Feb. 5, 2009

Related U.S. Application Data

(63) Continuation-in-part of application No. 11/649,829, filed on Jan. 5, 2007, now Pat. No. 7,485,016.

(30) Foreign Application Priority Data

Jan. 6, 2006 (JP) ..... 2006-001913

(51) Int. Cl.
*H01R 11/22* (2006.01)

(52) U.S. Cl. ..... 439/851; 439/852; 439/857; 439/748

(58) Field of Classification Search ..... 439/851, 439/852, 856, 857, 843, 748
See application file for complete search history.

(56) References Cited

U.S. PATENT DOCUMENTS 4,834,681 A 5/1989 Chaillot
6,095,874 A 8/2000 Quaranta
7,485,016 B2 * 2/2009 Ishigami ..... 439/851
2006/0121797 A1 6/2006 Casses et al.

FOREIGN PATENT DOCUMENTS

EP 0 959 531 A2 11/1999
JP 06-073878 U 10/1994
JP 11-345645 A 12/1999

* cited by examiner

*Primary Examiner*—Edwin A. Leon
*Assistant Examiner*—Vanessa Girardi
(74) *Attorney, Agent, or Firm*—Rader, Fishman & Grauer, PLLC

(57) ABSTRACT

The female terminal with guiding piece according to the present invention comprises a tubular body and a connecting part. Two vertical walls of the body are provided respectively with spring pieces cut and raised therefrom and formed to have an end on the rear side in the depth direction serving as a fixed end and an end on the front side serving as a free end and the free end coming closer to the vertical wall opposing to said vertical wall. The two vertical walls are provided respectively with guiding pieces at the front ends in the depth direction thereof, said guiding pieces being provided by plate pieces bent inward from the vertical walls into the body to cover spaces between the front ends in the depth direction of said vertical walls and the top ends of the spring pieces.

8 Claims, 6 Drawing Sheets

FEMALE TERMINAL WITH GUIDING PIECE

BACKGROUND OF THE INVENTION

1. Field of the Invention

The present invention belongs to a technical field of female terminals that comprise a tubular body and a connecting part integrally provided on the body to connect electric wire.

2. Description of Related Art

Japanese Patent Publication (Unexamined) No. HEISEI 11-345645 discloses a female terminal of this kind. In the terminal of this publication, a terminal-receiving cutout is opened in a mating end wall provided at the front end of a contact part, contact preload ledges are provided by plate pieces bent inward from the terminal-receiving cutout, and a pair of contact arms are provided inside the contact part. Forming of the contact part from a blank is done by bending and raising the contact arms from a bottom wall, bending top walls with respect to side walls, bending the side walls with respect to the bottom wall, bending and raising the contact preload ledges from the mating end wall, bending the mating end wall with respect to the bottom wall, and bending mating end side walls with respect to the fitting-end wall. On the other hand, Japanese Utility Model Publication (Unexamined) No. HEISEI 6-73878 discloses a socket connector that comprises a socket contact having a contact part for contacting a pin contact and a socket insulator for holding the socket contact and is characterized in that an outlet part of a pin contact insertion hole provided in the socket insulator is extended to protrude toward the contact part of the socket contact.

SUMMARY OF THE INVENTION

In the terminal of Japanese Patent Publication (Unexamined) No. HEISEI 11-345645, when a male terminal such as a pin is inserted with a greater tilt than a regular insertion angle, namely, a so-called oblique insertion is made, the top end of the pin will touch the contact preload ledge and the pin will be guided by the contact preload ledge onto the contact arms. Thus when the male terminal touches the contact arm, the tilt angle of the oblique insertion is restrained, and this reduces any load including buckling load on the contact arm, to which the contact arm is not subjected at the time of regular insertion of a male terminal. The socket connector of Japanese Utility Model Publication (Unexamined) No. HEISEI 6-73878 exhibits a similar function because a pin is guided by the insertion hole onto the contact part of the socket contact.

Unlike the socket connector of Japanese Utility Model Publication (Unexamined) No. HEISEI 6-73878 wherein a socket contact comprising an electrically conductive member and a socket insulator comprising an insulating member are combined to structure the connector, when a terminal is structured by bending a single blank prepared in a given configuration as is the case of the terminal of Japanese Patent Publication (Unexamined) No. HEISEI 11-345645, it is keenly desired to reduce any load due to oblique insertion. In that case, it is desired that a contact part which stores contact arms be made in a tubular form from a viewpoint of ensuring strengths against loads including those of bending and twisting, and it is also desired that the production process be simplified as much as possible.

The present invention was made from such viewpoints and its object is to provide a female terminal with guiding piece, wherein a single blank prepared in a given configuration is bent to structure a tubular body, spring pieces are cut and raised from walls constituting the body, and ends of the walls are bent inward to provide guiding pieces, hence the body is made tubular to secure strengths, a tilt angle when a male terminal touches the spring piece in case of oblique insertion is restrained greatly, and this in turn greatly reduces loads to which the spring pieces are subjected by oblique insertion, and moreover, the production is easy.

The female terminal with guiding piece according to the present invention comprises a tubular body having two lateral walls facing in a height direction and opposing to each other and two vertical walls facing in a width direction perpendicular to the height direction and opposing to each other, and extending in a depth direction perpendicular to both the height direction and the width direction; and a connecting part being aligned with the body on a rear side in the depth direction, being provided integrally with the body and being structured to connect to a conductor including electric wire; and the two vertical walls being provided respectively with spring pieces cut and raised therefrom and formed to have an end on the rear side in the depth direction serving as a fixed end and an end on the front side serving as a free end and the free end coming closer to the vertical wall opposing to said vertical wall; and the two vertical walls being provided respectively with guiding pieces at the front ends in the depth direction thereof, said guiding pieces being provided by plate pieces bent inward from the vertical walls into the body to cover spaces between the front ends in the depth direction of said vertical walls and the top ends of the spring pieces.

As a single blank prepared in a given configuration is bent to structure the tubular body, strengths against loads including bending and twisting are secured and the spring pieces and the like inside are protected effectively. When a male terminal is inserted obliquely from the front side in the depth direction of the body, the top end of the male terminal will touch one guiding piece, then as the top end of the male terminal will be guided by the guiding piece onto one spring piece, when the male terminal touches the spring piece, the tilt angle of the oblique insertion will be restrained, and this will reduce loads on the spring piece including buckling load, to which the spring piece is not subjected if the male terminal is inserted regularly.

In this case, unlike the terminal of Japanese Patent Publication (Unexamined) No. HEISEI 11-345645, wherein contact preload ledges are formed by bending inward some portions of the mating end wall provided to face in the depth direction at the front in the depth direction of the body, as the guiding pieces are provided by bending plate pieces extending toward the front in the depth direction from the vertical walls inward into the body, the guiding pieces can be made longer, and in turn, the lengths for guiding the top end of the male terminal toward the spring pieces can be made greater and the tilt angle of oblique insertion when the male terminal touches one spring piece can be reduced greatly, and in turn, this can greatly reduce the loads to which the spring piece is subjected by the oblique insertion. Furthermore, as the guiding pieces can be made longer, processing of the guiding pieces can be made more easily and the degree of freedom in determining their configurations can be enhanced, and this in turn also greatly reduces the loads to which the spring pieces are subjected by the oblique insertion.

Now, molding of the body from the blank is made by bending and raising the spring pieces and the guiding pieces from the vertical walls, bending the lateral wall located on an edge of the blank with respect to the vertical wall, and bending the two vertical walls with respect to the lateral wall located on the inner side in the blank. Hence the production is easier in comparison with the terminal of Japanese Patent Publication (Unexamined) No. HEISEI 11-345645, which requires, in addition to processes similar to those, processes of bending the mating end wall with respect to the bottom wall and bending the mating end side walls with respect to the mating end wall.

Accordingly, in the female terminal with guiding piece according to the present invention, as a single blank prepared in a given configuration is bent to structure a tubular body, spring pieces are cut and raised from walls constituting the body, and ends of the walls are bent inward to provide guiding pieces, the body is made tubular to secure strengths, a tilt angle when a male terminal touches the spring piece in case of oblique insertion is restrained greatly, and this in turn greatly reduces loads to which the spring pieces are subjected by oblique insertion, and moreover, the production is made easier.

In the female terminal with guiding piece according to the present invention, each of the guiding pieces may extend to come closer to the vertical wall opposing to the vertical wall on which said guiding piece is provided as the guiding piece proceeds toward the rear in the depth direction.

With this arrangement, when the top end of the male terminal being inserted obliquely touches one guiding piece and is guided toward the spring pieces, the tilt angle of the oblique insertion will be reduced smoothly, hence the insertion resistance will be smaller. Moreover, the production is easy.

In the female terminal with guiding piece according to the present invention, the free end of each spring piece may be bent toward the vertical wall from which said spring piece is cut and raised.

With this arrangement, a contact point is formed at the bent portion and it is easier to define the contact point.

The female terminal with guiding piece according to the present invention may be so structured that ends in the height direction of the vertical walls being integrally provided on both the ends in the width direction of the lateral wall, respectively, and ends in the width direction of end walls facing in the height direction being integrally provided on the remaining ends in the height direction of these vertical walls, respectively, these two end walls being butted together in the width direction or overlapped together in the height direction, and these two end walls constituting the lateral wall opposing to said lateral wall.

With this arrangement, when the two end walls are butted together in the width direction, the female terminal with guiding piece becomes symmetrical in the width direction, the dimensions in the height direction decrease to achieve reduction in the height. Moreover, when the two end walls are overlapped together in the height direction, stresses will be dispersed in the two end walls, hence the strengths of the body against loads including bending and twisting are enhanced.

DETAILED DESCRIPTION OF THE INVENTION

Figure 1:
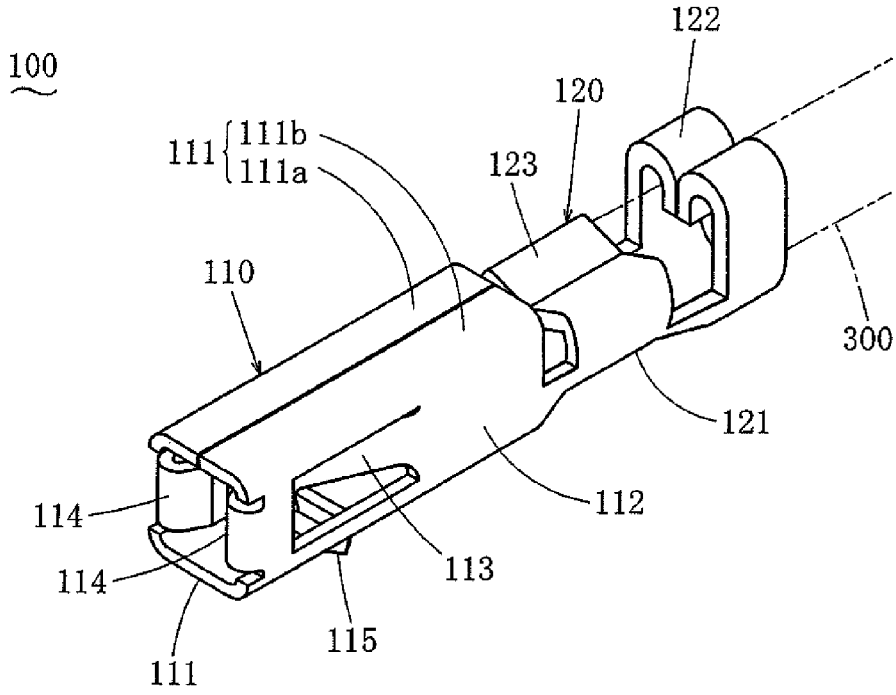
FIG. 1 is a perspective view of the female terminal with guiding piece of one embodiment.
Figure 2:
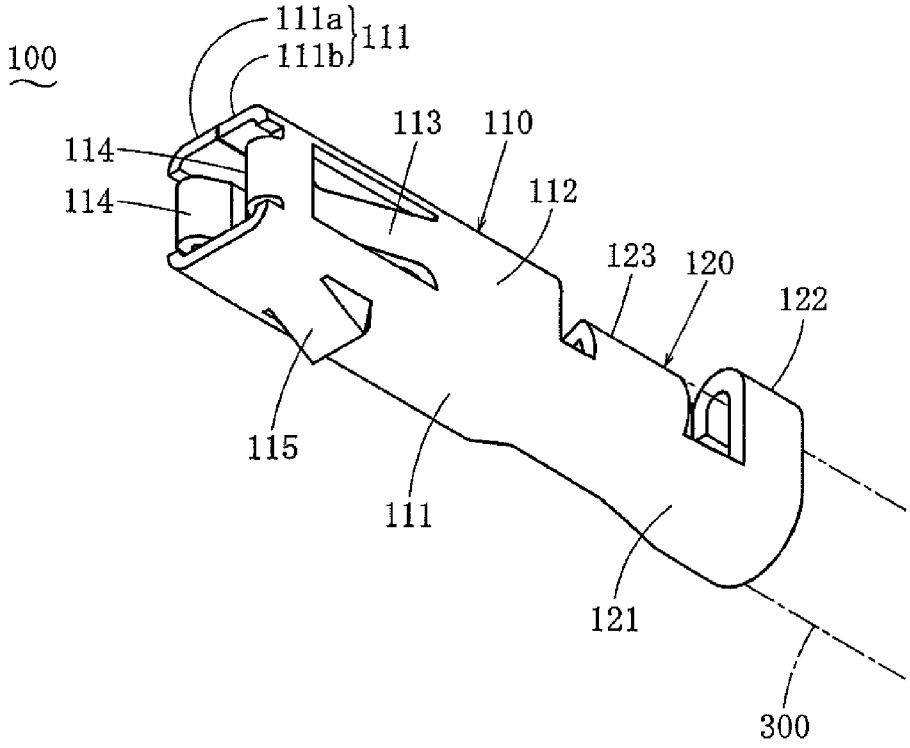
FIG. 2 is a perspective view of the female terminal with guiding piece of the embodiment seen from a direction different from that of FIG. 1.
Figure 3:
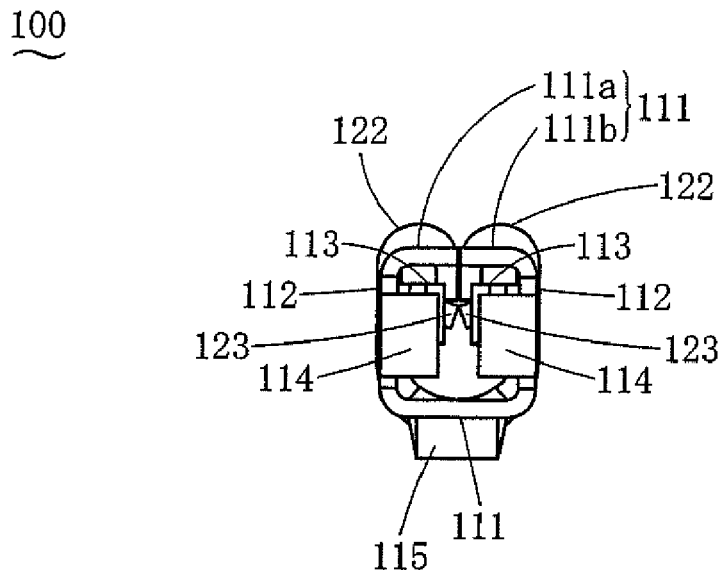
FIG. 3 is a front view of the female terminal with guiding piece of the embodiment.
Figure 4:
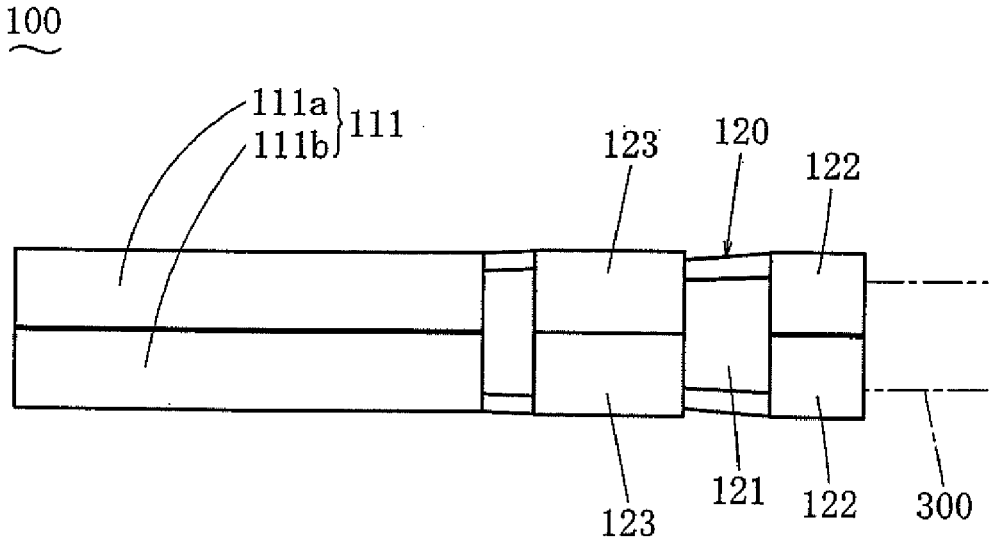
FIG. 4 is a plan view of the female terminal with guiding piece of the embodiment.
Figure 5:
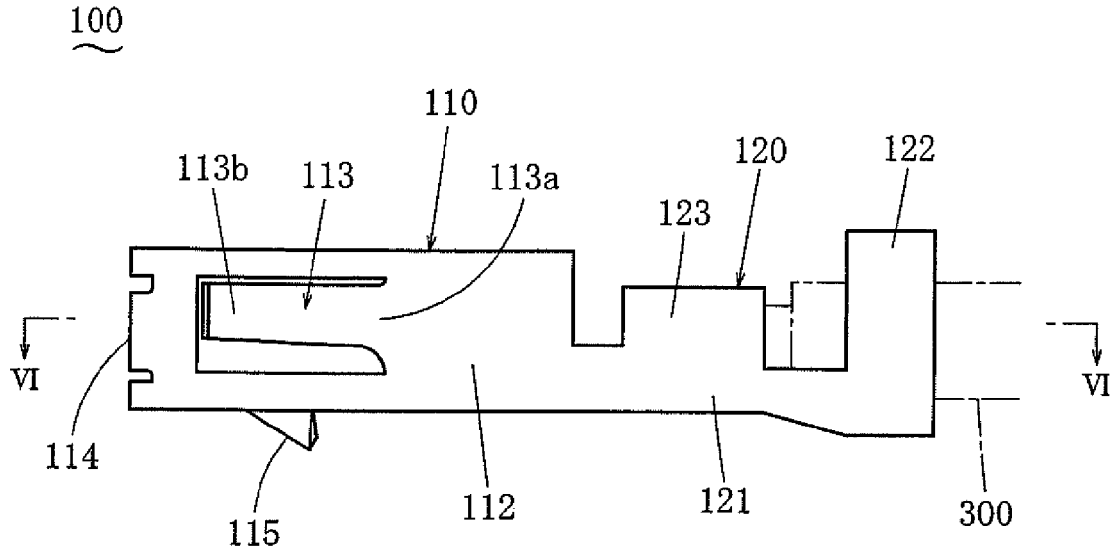
FIG. 5 is a side view of the female terminal with guiding piece of the embodiment.

In the following, the embodiment of the present invention will be described. FIG. 1 through FIG. 6 illustrate the female terminal with guiding piece 100 of the embodiment. This female terminal with guiding piece 100 is fitted with a well-known male terminal such as plug. A male terminal 200 illustrated in this embodiment is a bar-like member made of an electrically conductive material as illustrated by imaginary line in FIG. 8. The male terminal suffices to be a bar-like or plate-like member having electrical conductivity, and its sectional form does not matter. The female terminal with guiding piece 100 may be stored inside a housing (not illustrated) or it may be used just as externally exposed. This also applies to the male terminal. In the following, a height direction, a width direction and a depth direction all perpendicular to each other are defined, and the description will be given on the basis of them. With reference to FIG. 5, the left-right direction of the diagram is the depth direction, the left is the front and the right is the rear, the top-bottom direction of the diagrams is the height direction, and the direction perpendicular to the plane of the diagrams is the width direction.

The female terminal with guiding piece 100 of the embodiment is made of an electrically conductive material and comprises a tubular body 110 and a connecting part 120 that is aligned with the body 110 on the rear side in the depth direction and is integrally provided with the body 110.

The body 110 comprises two lateral walls 111 facing in the height direction and opposing to each other and two vertical walls 112 facing in the width direction and opposing to each other. These two lateral walls 111 and two vertical walls 112 are so provided that the respective neighboring walls are integral to each other. The lateral walls 111 have, when seen in their thickness direction, a substantially rectangular form, one side being in the depth direction and the other side in the width direction, and the vertical walls 112 have, when seen in their thickness direction, a substantially rectangular form, one side being in the depth direction and the other side in the height direction. As the larger area faces of the lateral walls 111 are perpendicular to the height direction, the lateral walls 111 face in the height direction. The two lateral walls 111 are opposed to each other in the height direction. On the other hand, as the larger area faces of both the two vertical walls 112 are perpendicular to the width direction, the vertical walls 112 face in the width direction. The two vertical walls 112 are opposed to each other in the width direction. The body 110 is comprised of two lateral walls 111 and two vertical walls 112 in a tubular form and extends in the depth direction.

The connecting part 120 is structured to connect to a wire 300. The connecting part 120 comprises a base 121 having a U-shaped section and extending rearward in the depth direction from the lateral wall 111 and the vertical walls 112 of the body 110, an insulation barrel 122 and a wire barrel 123 rising from both the ends in the width direction of the base 121, and is structured to crimp-connect a wire 300 by crimping the insulation barrel 122 on the insulation of the wire 300 and crimping the wire barrel 123 on the core of the wire exposed from the insulation. However, the connecting part may be structured, for example, to insulation-displacement-connect a wire or may be structured to connect to a wire by piercing. The connecting part may be structured to connect to a conductor other than a wire. Other conductors include, for example, flat-type flexible cables such as FFC (flexible flat cable) and FPC (flexible printed circuit).

The two vertical walls 112 are respectively provided with spring pieces 113 by cutting and raising. The spring pieces 113 have, when seen in their thickness direction, a substantially rectangular form, one side being in the depth direction and the other side being in the height direction. Each spring piece 113 is fixed to the vertical wall 112 with the rear end in the depth direction thereof serving as a fixed end 113*a* and the front end thereof being a free end 113*b*, thus it has a cantilever-like structure. Moreover, the spring piece 113 is so formed that its free end 113*b* comes closer to the vertical wall 112 opposing to the vertical wall 112 on which said spring piece 113 is provided. Furthermore, the free end 113*b* of the spring piece 113 is bent toward the vertical wall 112 from which said spring piece 113 is cut and raised. This free end 113*b* is so bent that its top end comes closer to the vertical wall 112 from which said spring piece 113 is cut and raised. Thus the free end side of the spring piece 113 is formed into a substantially V-shaped form when seen in the height direction.

Figure 6:
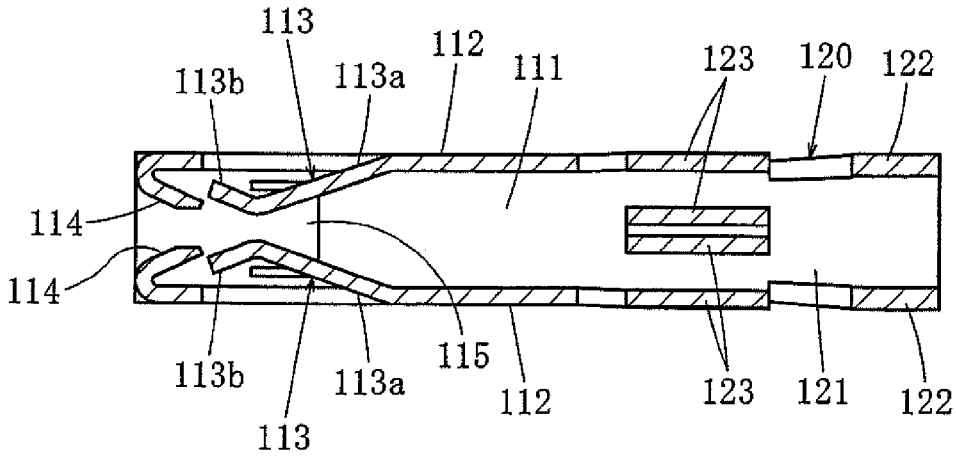
FIG. 6 is a sectional view along a line VI-VI of FIG. 5.
Figure 8:
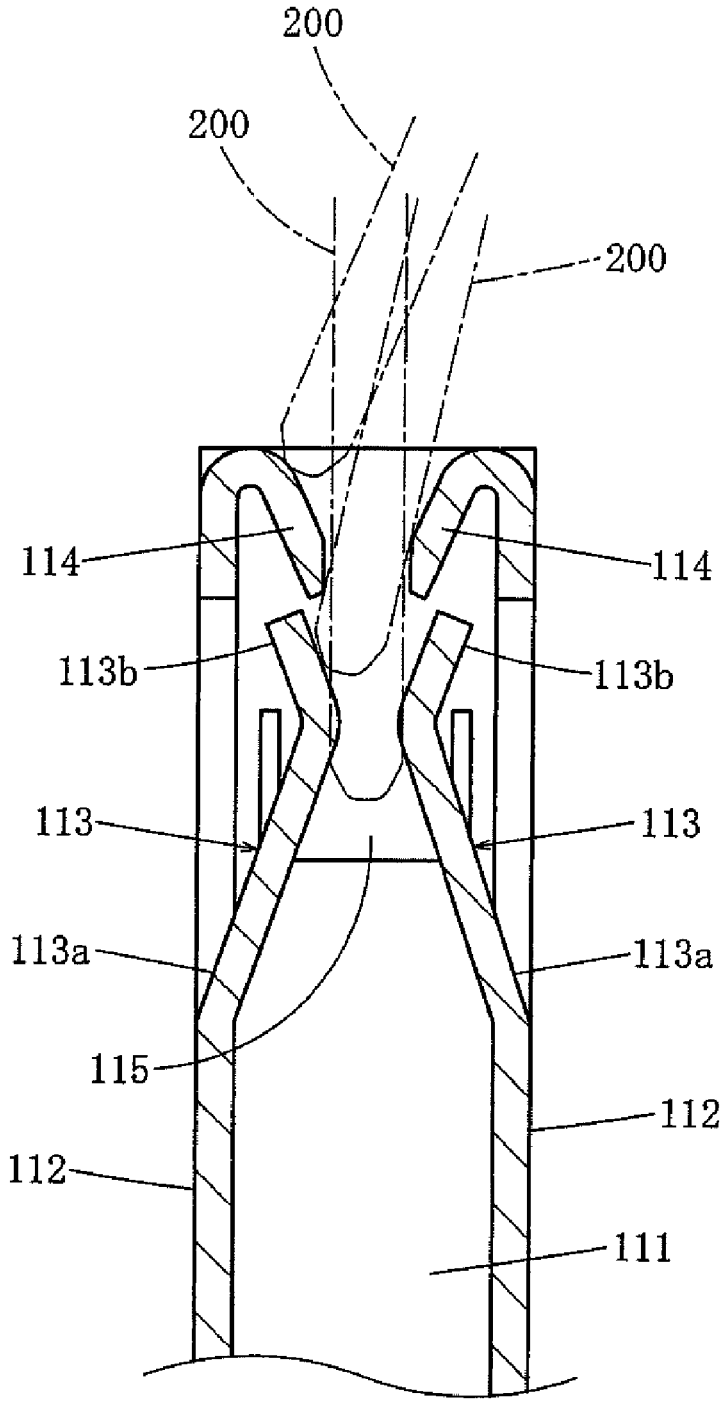
FIG. 8 is an enlarged sectional view for describing a tilt angle when a male terminal is inserted obliquely into the female terminal with guiding piece of the embodiment. The male terminal is illustrated by imaginary line.

As illustrated in FIG. 6 and FIG. 8, at the front ends in the depth direction of the two vertical walls 112, guiding pieces 114 are provided respectively by plate pieces bent from the vertical walls 112 inward into the body 110. The guiding piece 114 is provided to cover a space between the front end in the depth direction of the vertical wall 112 on which the guiding piece 114 is provided and the top end of the free end 113*b* of the spring piece 113. The guiding piece 114 extends to come closer to the vertical wall 112 opposing to the vertical wall 112 on which said guiding piece 114 is provided as it proceeds toward the rear in the depth direction. As illustrated in FIG. 6 and FIG. 8, this guiding piece 114 extends substantially straight as seen in the height direction. The guiding piece may, for example, be curved or bent convexly toward the opposing guiding piece as seen in the height direction, or conversely, the guiding piece may be curved or bent convexly toward the vertical wall on which the guiding piece is provided as seen in the height direction. The inside corner of the top end of the guiding piece 114 is chamfered, but such chamfering may be omitted.

Ends in the height direction of the vertical walls 112 are integrally provided on both the ends in the width direction of the lateral wall 111, respectively. More specifically, one end in the height direction of one vertical wall 112 is integrally provided on one end in the width direction of the lateral wall 111, and one end in the height direction of the other vertical wall 112 is integrally provided on the other end in the width direction of the lateral wall 111. And on the remaining ends in the height direction of these vertical walls 112, namely, on the ends far from the lateral wall 11, the ends in the width direction of the end walls 111*a*, 111*b* facing in the height direction are integrally provided, respectively. To put it in other words, on each edge extending substantially in the depth direction on both the ends in the width direction of the lateral wall 111, one of the edges extending substantially in the depth direction on both the ends in the height direction of each vertical wall 112 is integrally provided. And on the other edge of each of these vertical walls 112, one of the edges extending substantially in the depth direction on both the ends in the width direction of the end wall 111*a*, 111*b* facing in the height direction is provided integrally. Then, these two end walls 111*a*, 111*b* are butted together in the width direction, and these two end walls 111*a*, 111*b* constitute a lateral wall 111 opposing to said lateral wall 111. Each of the end walls 111*a*, 111*b* has, when seen in its thickness direction, a substantially rectangular form, one side being in the depth direction and the other side being in the width direction. As the larger faces of both the end walls 111*a*, 111*b* are perpendicular to the height direction, they are facing in the height direction. As a modification, these two end walls may be overlapped with each other in the height direction; thus these two end walls may constitute a lateral wall opposing to said lateral wall. In this case, the dimension in the width direction of one end wall or those of both the end walls are greater than that of said embodiment.

115 denotes a locking piece which protrudes on one side in the height direction from the lateral wall 111 of the body 110, and when the female terminal with guiding piece 100 is stored in a housing, the locking piece fits in a concaved part of the housing to prevent the female terminal with guiding piece 100 from coming off the housing easily. The present invention includes an embodiment of the female terminal with guiding piece on which such a locking piece is not provided.

Figure 7:
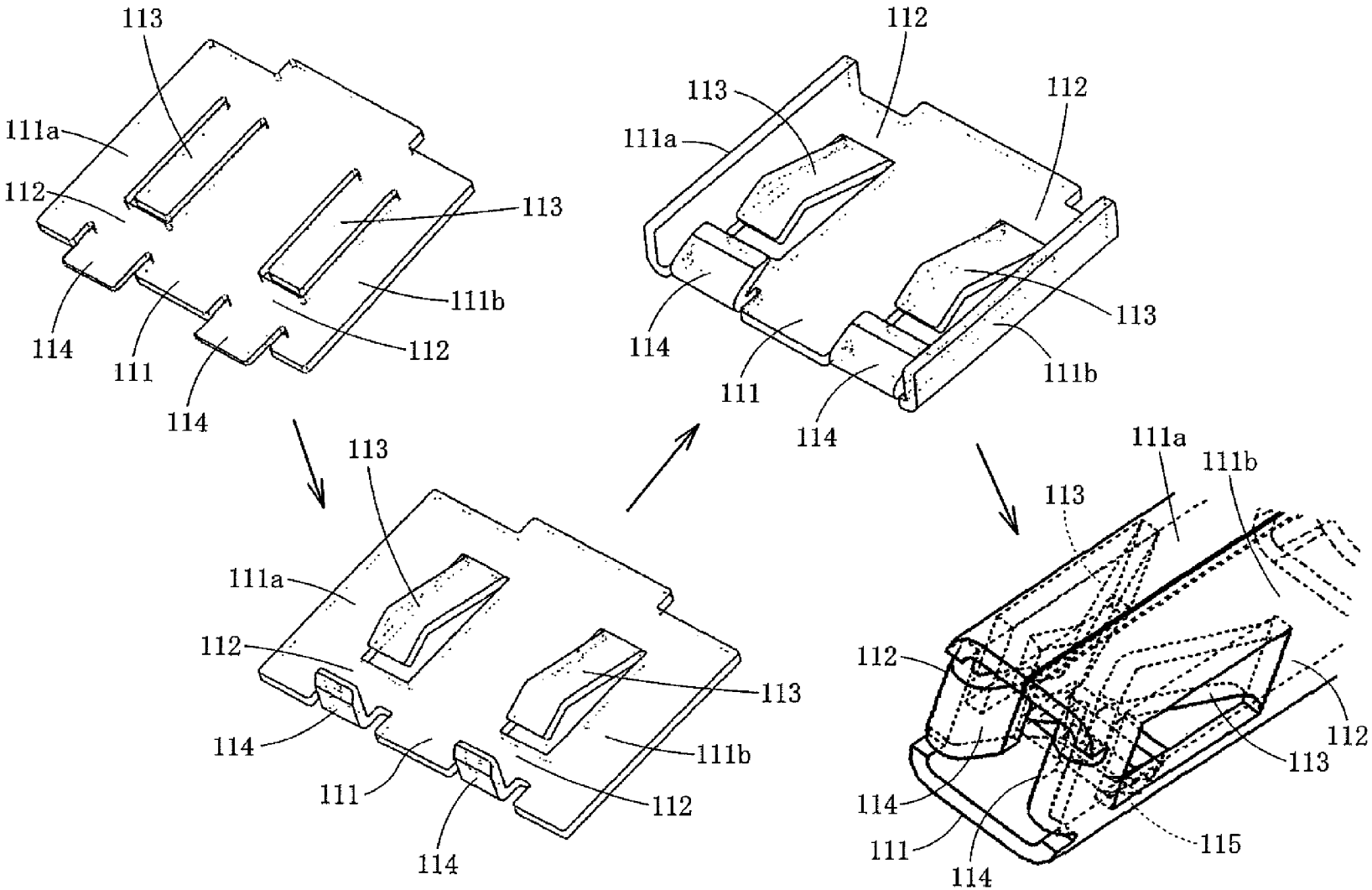
FIG. 7 is an explanatory diagram that illustrates in outline the processes of bending a blank to form the body and the like among the production processes of the female terminal with guiding piece of the embodiment. For easier comprehension, a locking piece is omitted. Moreover, the connecting part is also omitted.

This female terminal with guiding piece 100 is formed by bending a single blank prepared in a given configuration. This blank is made by, for example, punching a plate material with a die. FIG. 7 illustrates, of the production processes of the female terminal with guiding piece 100, the process of forming the body 110 and the like by bending the blank. In the blank, each spring piece 113 is separated except one end thereof (the top-left diagram). Next, the spring pieces 113 and the guiding pieces 114 are bent and raised from the vertical walls 112. This bending is done around imaginary axes extending in the height direction as one see in the female terminal with guiding piece 100 after forming (the bottom-left diagram). Next, bending of the spring pieces 113 and the guiding pieces 114 is advanced further and the end walls 111*a*, 111*b* are bent with respect to the vertical walls 112, respectively. This bending of the end walls 111*a*, 111*b* is done around imaginary axes extending in the depth direction as one see in the female terminal with guiding piece 100 after forming (the top-right diagram). Then, the vertical walls 112 are bent with respect to the lateral wall 111 respectively to complete the female terminal with guiding piece 100. This bending of the vertical walls 112 is done around imaginary axes extending in the depth direction as one see in the female terminal with guiding piece 100 after forming (the bottom-right diagram).

Accordingly, in the female terminal with guiding piece 100 of said embodiment, one blank prepared in a given configuration is bent to structure the tubular body 110, hence strengths against loads including bending and twisting are secured and the spring pieces 113 and the like inside are protected effectively. In FIG. 8, a male terminal 200 is illustrated in three positions by imaginary line, and among them, one with the largest tilt angle and the shortest insertion length is defined as the first state, one with a smaller tilt angle than that and an intermediate insertion length as the second state, and one with an almost nil tilt angle and the longest insertion length as the third state, respectively. Then, when the male terminal 200 is inserted obliquely from the front side in the depth direction of the body 110, the top end of the male terminal 200 will touch one guiding piece 114 (the first state), and as the top end of the male terminal 200 will be guided by this guiding piece 114 onto one spring piece 113, when the male terminal 200 touches the spring piece 113, the tilt angle of the oblique insertion will be restrained (the second state), and this will reduce loads including buckling load on the spring piece 113, to which the spring piece 113 is not subjected if the male terminal 200 is inserted regularly. Then, the male terminal 200 will reach the third state and insertion will proceed further more.

In this case, unlike the terminal of Japanese Patent Publication (Unexamined) No. HEISEI 11-345645, wherein contact preload ledges are formed by bending inward some portions of the mating end wall provided to face in the depth direction at the front in the depth direction of the body, as the guiding pieces 114 are provided by bending plate pieces extending toward the front in the depth direction from the vertical walls 112 inward into the body 110, the guiding pieces 114 can be made longer, and in turn, the lengths for guiding the top end of the male terminal 200 toward the spring pieces 113 can be made greater and the tilt angle of oblique insertion when the male terminal 200 touches one spring piece 113 can be reduced greatly, and in turn, this can greatly reduce the loads to which the spring piece 113 is subjected by the oblique insertion. Furthermore, as the guiding pieces 114 can be made longer, processing of the guiding pieces 114 can be made more easily and the degree of freedom in determining their configurations can be enhanced, and this in turn also greatly reduces the loads to which the spring pieces 113 are subjected by the oblique insertion.

Now, molding of the body 110 from the blank is made by bending and raising the spring pieces 113 and the guiding pieces 114 from the vertical walls 112, bending the end walls 111*a*, 111*b*, which are located at the edges of the blank and to form one lateral wall, with respect to the vertical walls 112 respectively, and bending the two vertical walls 112 with respect to the lateral wall 111 located on the inner side in the blank. Hence the production is easier in comparison with the terminal of Japanese Patent Publication (Unexamined) No. HEISEI 11-345645, which requires, in addition to a similar processes, processes of bending the mating end wall with respect to the bottom wall and bending the mating end side walls with respect to the mating end wall.

It is sufficient for the guiding pieces of the female terminal with guiding piece according to the present invention that the guiding pieces are constituted by plate pieces bent inward into the body from the vertical walls to cover the spaces between the front ends in the depth direction of said vertical walls and the top ends of the spring pieces. Hence the configuration of the guiding pieces is not limited particularly. However, in this embodiment, each guiding piece 114 extends to come closer to the vertical wall 112 opposing to the vertical wall 112 on which said guiding piece 114 is provided as it proceeds toward the rear in the depth direction. With this arrangement, when the top end of the male terminal 200 being inserted obliquely touches one guiding piece 114 and is guided toward the spring pieces 113, the tilt angle of the oblique insertion will be reduced smoothly, hence the insertion resistance will be smaller. Moreover, the production is easy.

It is sufficient for the spring pieces of the female terminal with guiding piece according to the present invention that each spring is formed from one vertical wall in such a way that the rear end in the depth direction is a fixed end and the front end is a free end and the free end comes closer to the vertical wall opposing to said vertical wall. However, in this embodiment, the free end 113*b* of the spring piece 113 is bent toward the vertical wall 112 from which said spring piece 113 is cut and raised. With this arrangement, a contact point is formed at the bent portion and it is easier to define the contact point.

It is sufficient for the female terminal with guiding piece according to the present invention that the two lateral walls face in the height direction and oppose to each other, and moreover, these two lateral walls together with two vertical walls facing in the width direction and opposing to each other structure a tubular body extending in the depth direction. However, in this embodiment, ends in the height direction of the vertical walls 112 are integrally provided on both the ends in the width direction of the lateral wall 111, respectively, and on the remaining ends of these vertical walls 112, the ends in the width direction of the end walls 111*a*, 111*b* facing in the height direction are integrally provided, respectively, then, these two end walls 111*a*, 111*b* are butted together in the width direction or overlapped together in the height direction, and these two end walls 111*a*, 111*b* constitute a lateral wall 111 opposing to said lateral wall 111. With this arrangement, when the two end walls 111*a*, 111*b* are butted together in the width direction, the female terminal with guiding piece 100 becomes symmetrical in the width direction, and the dimensions in the height direction decrease to achieve reduction in the height. Moreover, when the two end walls are overlapped together in the height direction, stresses will be dispersed in the two end walls, hence the strengths of the body against loads including bending and twisting are enhanced.

Figure 9:
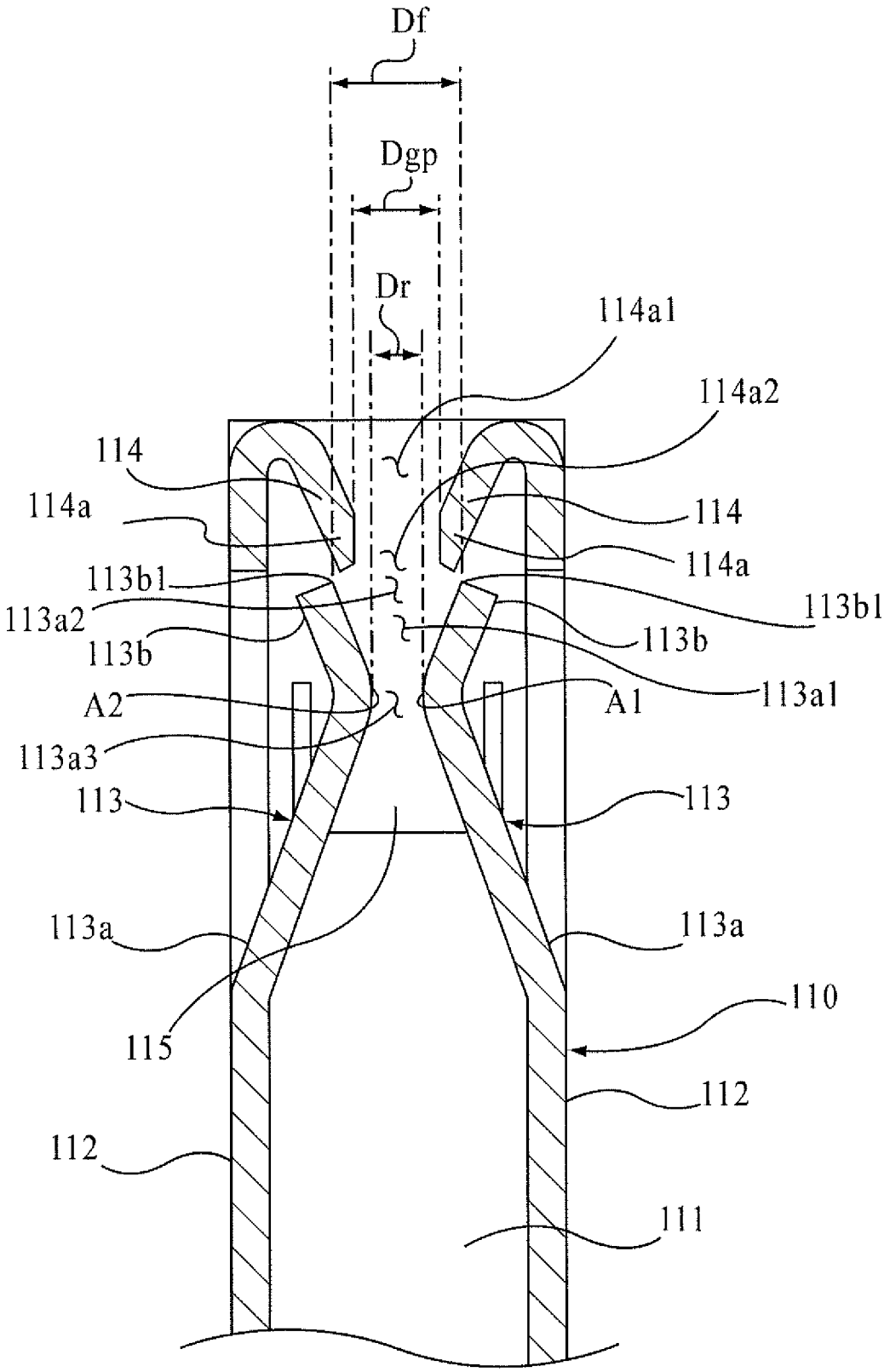
FIG. 9 is an enlarged sectional view as similarly shown in FIG. 8 without the tilt angles of the male terminal and illustrating the distal relationships between the guide pieces and spring pieces of the invention.

With reference to FIG. 9, the fixed end 113*a* and the free end 113*b* of each spring piece 113 is integrally connected to each other at respective apexes A1 and A2 to define a V-shaped configuration as viewed in cross-section. A skilled artisan would appreciate that one of the spring pieces 113 forms the V-shape while a remaining one of the spring pieces 113 also forms the V-shape but is inverted relative to the other spring piece 113. Also, the guide pieces 114 form a first male terminal receiving channel 114*a*1 therebetween. Note that the first male terminal receiving channel 114*a* tapers inwardly into the tubular body 110 toward the connecting part 120 (See FIGS. 1, 2 and 6) and terminates in a guide piece opening 114*a*2. As shown in FIG. 9, the guide piece opening 114*a*2 is defined by respective ones of the facially-opposing respective guide piece ends 114*a* that are separated from one another by a guide piece distance Dgp;

Also, in FIG. 9, respective ones of the free ends 113*b* of the two spring pieces 113 form a second male terminal receiving channel 113*a*1 therebetween. The second male terminal receiving channel is disposed interiorly of the tubular body 110 and tapers inwardly into the tubular body 110 toward the connecting part 120 (See FIGS. 1, 2 and 6). The second male terminal receiving channel 113*a*1 has a frontward spring piece opening 113*a*2 that is disposed adjacent the guide piece opening 114*a*2 and is defined by facially-opposing respective tips 113*b*1 of the free ends 113*b* of the two spring pieces 113 and are separated from one another by a frontward distance Df. A rearward spring piece opening 113*a*3 is defined by the facially-opposing apexes A1, A2 of the two spring pieces 113 separated from one another by rearward distance Dr. A relationship of the guide piece distance Dgp, the frontward distance Df and the rearward distance Dr is:

$$Dr<Dgp<Df.$$

Said embodiment merely illustrates one example of the female terminal with guiding piece according to the present invention. Accordingly, the female terminal with guiding piece according to the present invention must not be construed limitedly by the description of said embodiment.

The disclosure of Japanese Patent Application No.2006-1913 filed on Jan. 6, 2006 including specification, drawings and claims is incorporated herein by reference in its entirety.

The invention claimed is:

1. A female terminal with guiding piece, comprising:

a tubular body having two lateral walls facing in a height direction and opposing to each other and two vertical walls facing in a width direction perpendicular to the height direction and opposing to each other, and extending in a depth direction perpendicular to both the height direction and the width direction;

a connecting part being aligned with the body on a rear side in the depth direction and integrally connected with the tubular body; and two spring pieces, each spring piece having a fixed end and a free end disposed opposite the fixed end, the fixed end and the free end integrally connected to each other at an apex to define a V-shaped configuration as viewed in cross-section, wherein each vertical wall is a single panel wall having a rectangularly-shaped cutout formed therethrough, the cutout is defined between a front side wall edge and a rear side wall edge, both the front side wall edge and the rear side wall edge extending in the height direction and between opposing disposed-apart side wall edges extending in the depth direction between the front side wall edge and rear side wall edge, a respective one of the spring pieces being integrally connected to a respective one of the rear side wall edges at the fixed end with the free end extending into the tubular body; and each vertical wall having a guiding piece at the front end in the depth direction thereof, said guiding pieces being plate pieces bent inward from the vertical walls into the tubular body to cover a space between the front ends in the depth direction of said vertical walls and the free ends of the spring pieces, the guide pieces forming a first male terminal receiving channel therebetween, the first male terminal receiving channel tapering inwardly into the tubular body toward the connecting part and terminating in a guide piece opening defined by facially-opposing respective guide piece ends separated from one another by a guide piece distance Dgp;

respective ones of the free ends of the two spring pieces forming a second male terminal receiving channel therebetween, the second male terminal receiving channel disposed interiorly of the tubular body and tapering inwardly into the tubular body toward the connecting part, the second male terminal receiving channel having a frontward spring piece opening disposed adjacent the guide piece opening and defined by facially-opposing respective tips of the free ends of the two spring pieces separated from one another by a frontward distance Df and a rearward spring piece opening defined by facially-opposing apexes of the two spring pieces separated from one another by rearward distance Dr; and a relationship of the guide piece distance Dgp, the frontward distance Df and the rearward distance Dr is:

$$Dr<Dgp<Df.$$

2. The female terminal with guiding piece according to claim 1, wherein respective ends in the height direction of the vertical walls are integrally provided on both the ends in the width direction of the lateral wall, and respective ends in the width direction of end walls facing in the height direction are integrally provided on remaining ends in the height direction of the vertical walls, respectively, the two end walls being abutted together in the width direction or overlapped together in the height direction, the two end walls constituting one of the lateral walls.

3. The female terminal with guiding piece according to claim 1, wherein the free end of each spring piece is bent toward the vertical wall from which said spring piece is integrally connected.

4. The female terminal with guiding piece according to claim 3, wherein respective ends in the height direction of the vertical walls are integrally provided on both ends in the width direction of the lateral wall and respective ends in the width direction of end walls facing in the height direction are integrally provided on remaining ends in the height direction of the vertical walls, the two end walls are abutted together in the width direction or overlapped together in the height direction, the two end walls constituting one of the lateral walls.

5. The female terminal with guiding piece according to claim 1, wherein each one of the guiding pieces extending close to the opposing vertical wall opposing the vertical wall on which said guiding piece being provided as the guiding piece extends toward the rear in the depth direction.

6. The female terminal with guiding piece according to claim 5, wherein respective ends in the height direction of the vertical walls are integrally provided on both ends in the width direction of the lateral wall and respective ends in the width direction of end walls facing in the height direction are integrally provided on the remaining ends in the height direction of the vertical walls, the two end walls our abutted together in the width direction or overlapped together in the height direction, the two end walls constituting one of the lateral walls.

7. The female terminal with guiding piece according to claim 5, wherein the free end of each spring piece is bent toward the vertical wall from which said spring piece is integrally connected.

8. The female terminal with guiding piece according to claim 7, wherein respective ends in the height direction of the vertical walls are integrally provided on both ends in the width direction of the lateral wall, respective ends in the width direction of end walls facing in the height direction are integrally provided on remaining ends in the height direction of the vertical walls, the two end walls are abutted together in the width direction or overlapped together in the height direction, the two end walls constituting one of the lateral walls.

* * * * *